US009236699B2

(12) United States Patent
Lai

(10) Patent No.: US 9,236,699 B2
(45) Date of Patent: Jan. 12, 2016

(54) POWER ADAPTER

(71) Applicant: CHICONY POWER TECHNOLOGY CO., LTD., New Tapei (TW)

(72) Inventor: Chyi-Lang Lai, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 14 days.

(21) Appl. No.: 14/260,742

(22) Filed: Apr. 24, 2014

(65) Prior Publication Data

US 2015/0311656 A1 Oct. 29, 2015

(51) Int. Cl.
*H01R 13/66* (2006.01)
*H01R 31/06* (2006.01)

(52) U.S. Cl.
CPC ..... *H01R 31/065* (2013.01); *H01R 13/665* (2013.01)

(58) Field of Classification Search
CPC ..... H01R 13/6658; H01R 13/658; H01R 23/025; H01R 23/7068; H01R 31/06; H01R 13/6625; H01R 23/005; H01R 23/02; H01R 31/00; H01R 33/7664; H01R 33/7685; H01R 27/02; H05K 1/0228
USPC ..... 439/76.1, 620.22, 655, 638
See application file for complete search history.

(56) References Cited

U.S. PATENT DOCUMENTS 5,967,807 A * 10/1999 Wu ..... 439/131
6,057,610 A * 5/2000 Nierescher ..... 307/72
6,162,067 A * 12/2000 Haga ..... 439/76.1
6,328,581 B1 * 12/2001 Lee et al. ..... 439/106
6,851,955 B2 * 2/2005 Chen ..... 439/76.1
7,002,808 B2 * 2/2006 Lim et al. ..... 361/752
7,212,420 B2 * 5/2007 Liao ..... 363/146
7,563,139 B1 * 7/2009 Wang ..... 439/638
7,628,621 B2 * 12/2009 Tsai ..... 439/131
7,658,625 B2 * 2/2010 Jubelirer et al. ..... 439/131
7,862,380 B1 * 1/2011 Wang ..... 439/620.22
7,983,064 B2 * 7/2011 Zhang et al. ..... 363/146
8,021,183 B2 * 9/2011 Early et al. ..... 439/382
8,043,100 B2 * 10/2011 Liao ..... 439/131
8,057,265 B2 * 11/2011 Youssefi-Shams et al. ... 439/655
8,337,250 B1 * 12/2012 Yang ..... 439/620.22
8,342,861 B2 * 1/2013 Stiehl et al. ..... 439/76.1
8,469,718 B2 * 6/2013 Kobayashi et al. ..... 439/55
8,608,489 B2 * 12/2013 Nogami et al. ..... 439/76.1
8,651,879 B2 * 2/2014 Stiehl et al. ..... 439/76.1
8,777,644 B2 * 7/2014 Pai ..... 439/131
8,790,124 B2 * 7/2014 Lee et al. ..... 439/131
8,934,261 B2 * 1/2015 Lin et al. ..... 361/792
2009/0289596 A1 * 11/2009 McGinley et al. ..... 320/111

* cited by examiner

*Primary Examiner* — Abdullah Riyami
*Assistant Examiner* — Vladimir Imas
(74) *Attorney, Agent, or Firm* — Muncy, Geissler, Olds & Lowe, P.C.

(57) ABSTRACT

A power adapter includes an adapter body including a positioning structure and an insertion slot disposed at two opposite sides relative to an accommodation chamber therein and an electrical plug member for connection to an external power source, and an electrical module including a circuit board mounted in the accommodation chamber for converting inputted AC power supply into DC power supply, an adapter plate fixedly mounted on the circuit board at right angles and inserted into the positioning structure to electrically connect the electrical plug member to the circuit board and a power transmission device electrically connected to the circuit board and facing toward the insertion slot for DC power supply output.

8 Claims, 7 Drawing Sheets

POWER ADAPTER

BACKGROUND OF THE INVENTION

1. Field of the Invention

The present invention relates to power adapter technology and more particularly, to a power adapter, which comprises an adapter body carrying an electrical plug member for power input, and an electrical module comprising a circuit board mounted in the adapter body, an adapter plate fixedly mounted at the circuit board at right angles and holding two metal conducting terminals in electrical connected between the electrical plug member and the circuit board and a power transmission device of power output.

2. Description of the Related Art

With fast development of the modern technology, many different kinds of electrical and electronic products have been created and widely used in our daily life, bringing comfort and convenience to people and improving the standard of living of the people. Mobile electrical and electronic products are operated by DC power supply. Because city power supply outputs simply provide AC power supply, power converter means must be used to convert AC power supply into DC power supply at a predetermined voltage level for use in mobile electrical and electronic products. Most electrical and electronic products have built therein a rechargeable battery that can be charged with city power supply through a power transformer.

Further, a power transformer has signal lines and/or power lines connected to a circuit board thereof for the transmission of signal, electric current and electric voltage. Conventional power transformers are capable of converting AC power supply into DC power supply, however, they have a complicated structure. Bonding or installation of signal lines and/or power lines consumes much labor and time. Any line misallocation and installation error will lead to failed products. Further, due to complicated arrangement of signal lines and power lines, conventional power adapters have a large size and high cost.

Therefore, it is desirable to provide simple, small-sized, low-cost means capable of converting AC power supply into DC power supply.

SUMMARY OF THE INVENTION

The present invention has been accomplished under the circumstances in view. It is therefore the main object of the present invention to provide a power adapter, which has the characteristics of small size, simple structure and low manufacturing cost.

To achieve this and other objects of the present invention, a power adapter of the invention comprises an adapter body and an electrical module. The adapter body comprises an accommodation chamber, a positioning structure and an insertion slot disposed at two opposite sides relative to the accommodation chamber, and an electrical plug member for connection to an external power source. The electrical module comprises a circuit board mounted in the accommodation chamber for converting inputted AC power supply into DC power supply, an adapter plate fixedly mounted on the circuit board at right angles and inserted into the positioning structure, two metal conducting terminals mounted at the adapter plate adapted to electrically connect the electrical plug member to the circuit board, and a power transmission device electrically connected to the circuit board and facing toward the insertion slot for DC power supply output.

Further, the positioning structure comprises an open frame defining therein a receiving chamber for accommodating the adapter plate, a pair of position-limit slats, a position-limit groove defined between the two position-limit slats and a positioning partition plate extended from the open frame and disposed at one lateral side relative to the receiving chamber. Further, the circuit board comprises an engagement slot forced into engagement with the positioning partition plate of the positioning structure of the adapter body.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
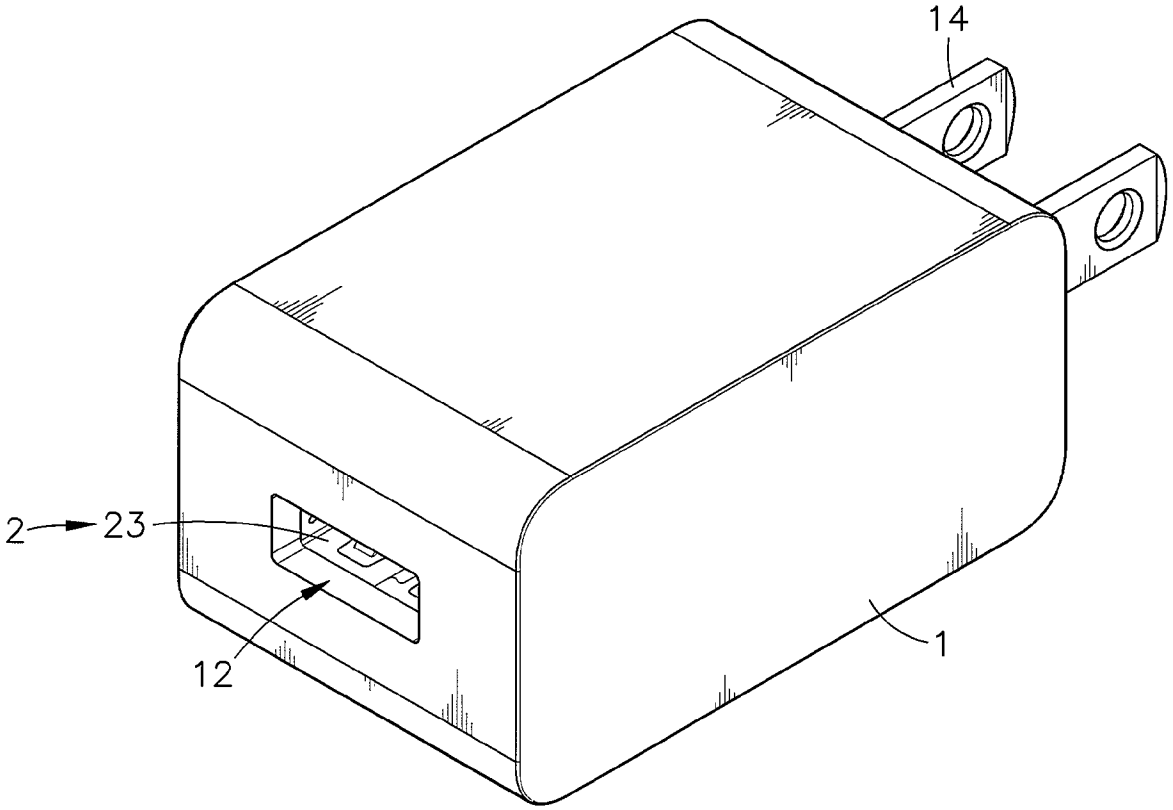
FIG. 1 is an oblique top elevational view of a power adapter in accordance with the present invention.
Figure 2:
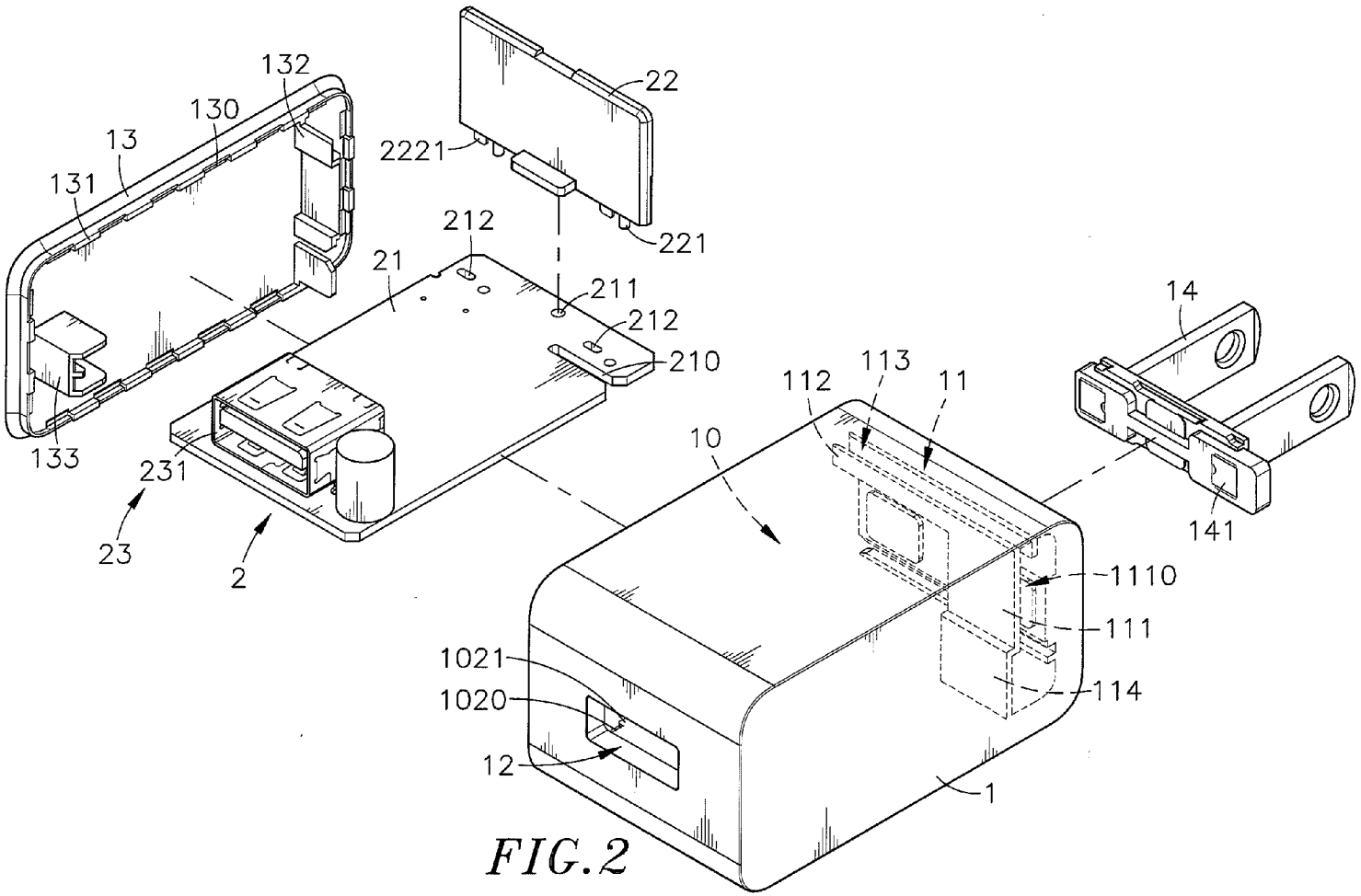
FIG. 2 is an exploded view of the power adapter in accordance with the present invention.
Figure 3:
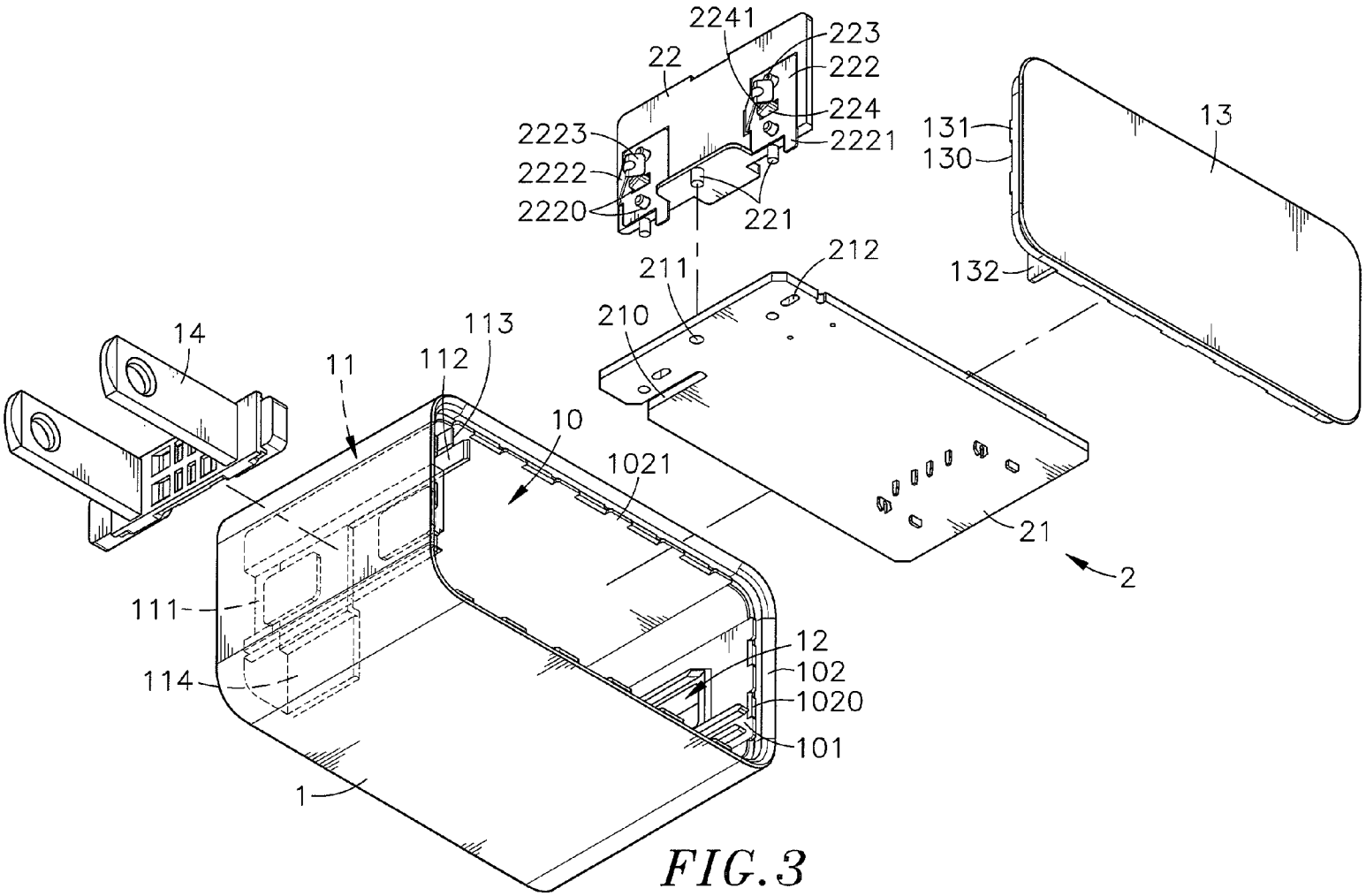
FIG. 3 corresponds to FIG. 2 when viewed from another angle.
Figure 4:
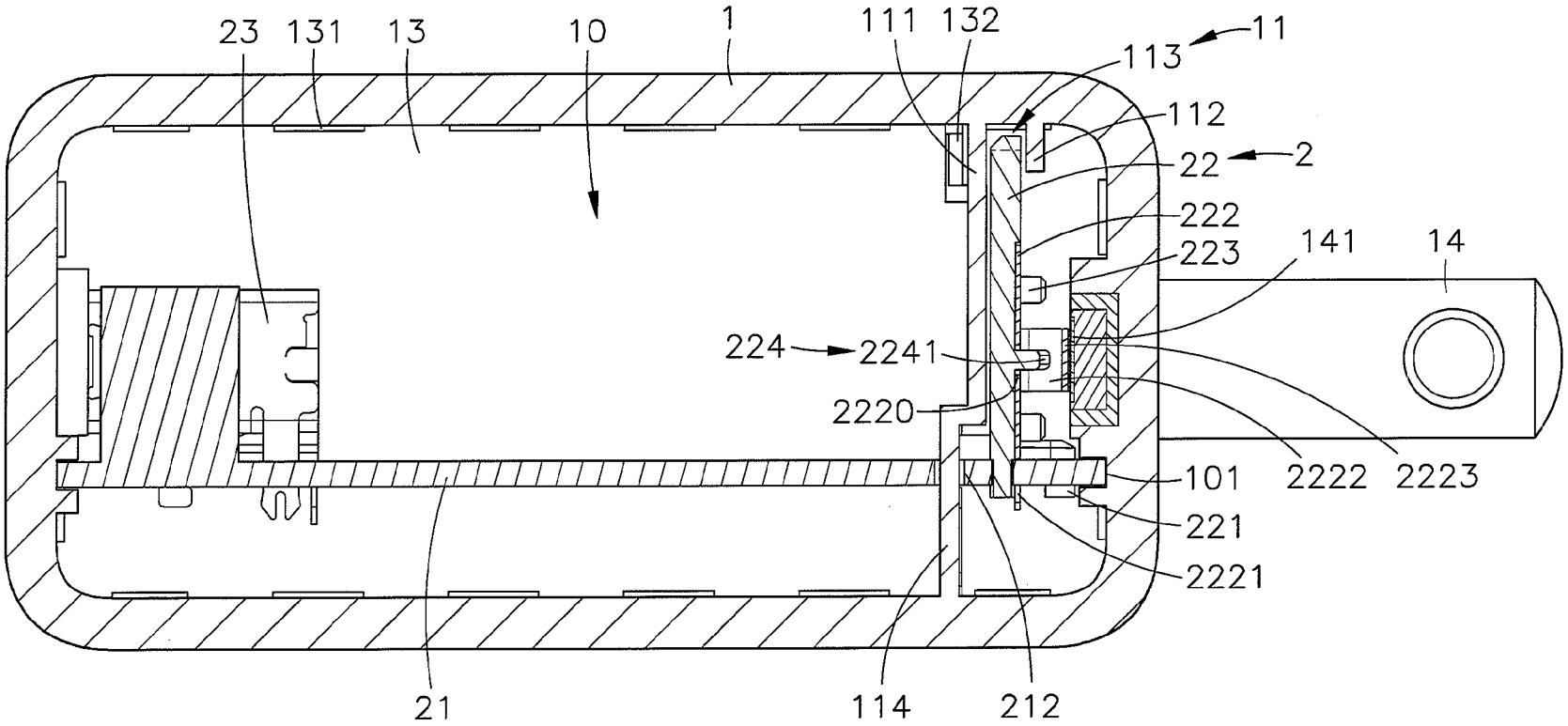
FIG. 4 is a sectional side view of the power adapter in accordance with the present invention.

Referring to FIGS. 1-4, a power adapter in accordance with the present invention is shown. The power adapter comprises an adapter body 1 and an electrical module 2.

The adapter body 1 is a rectangular box member comprising an accommodation chamber 10 defined therein, a positioning structure 11 that is located in the accommodation chamber 10 adjacent to one end, namely, the front end of the adapter body 1 and that comprises an open frame 111 defining therein a receiving chamber 1110, a pair of position-limit slats 112, a position-limit groove 113 defined between the two position-limit slats 112 and a positioning partition plate 114 extended from the open frame 111 and disposed at one lateral side relative to the receiving chamber 1110, an insertion slot 12 located in an opposite end thereof, namely, the rear end of the adapter body 1 remote from the positioning structure 11, two sliding grooves 101 respectively disposed in the accommodation chamber 10 adjacent to the opposing front and rear ends of the adapter body 1 and extending between two opposite lateral sides of the adapter body 1, an opening 102 defined in one lateral side of the adapter body 1 in communication with the accommodation chamber 10, and a plurality of retaining grooves 1020 and retaining lugs 1021 alternatively arranged around the opening 102. Further, a cover plate 13 is affixed to the adapter body 1 to enclose the opening 102. The cover plate 13 comprise a plurality of retaining lugs 131 and retaining grooves 130 respectively fastened to the retaining grooves 1020 and retaining lugs 1021 of the adapter body 1, at least one abutment plate 132 abutted against the positioning structure 11 of the adapter body 1, and a fence 133 stopped against an inside wall of the adapter body 1 around the insertion slot 12. Further, after fastened the retaining lugs 131 and retaining grooves 130 of the cover plate 13 to the retaining grooves 1020 and retaining lugs 1021 of the adapter body 1, an ultrasonic sealing technique or screws can be used to fixedly fasten the cover plate 13 and the adapter body 1 together. Further, an electrical plug member 14 is fixedly mounted in the receiving chamber 1110 inside the open frame 111 of the positioning structure 11 of the adapter body 1 and extended out of the adapter body 1, comprising two metal conducting contacts 141 suspending in the receiving chamber 1110.

The electrical module 2 comprises a circuit board 21, an adapter plate 22, and a power transmission device 23. The circuit board 21 comprises an engagement slot 210 transversely located at a predetermined location and adapted for engagement with the positioning partition plate 114 of the positioning structure 11 of the adapter body 1, a plurality of mounting holes 211 cut through opposing top and bottom walls thereof and arranged adjacent to one end thereof, and two electrical contact holes 212 at selected locations near the mounting holes 211. The adapter plate 22 comprises a plurality of bottom mounting rods 221 respectively press-fitted into the mounting holes 211 of the circuit board 21 to secure the adapter plate 22 to the circuit board 21 at right angles, two pairs of locating rods 223 symmetrically and bilaterally arranged at one side thereof at different elevations, and two stop blocks 224 respectively disposed between the two locating rods 223 of each of the two pairs of locating rods 223, and two metal conducting terminals 222 respectively electrically connected to the circuit board 21. The stop blocks 224 have a height larger than the locating rods 223, each defining a beveled bearing surface 2241. The metal conducting terminals 222 each comprise a plurality of locating holes 2220 respectively fastened to the locating rods 223 and the stop blocks 224, a connection leg 2221 respectively electrically connected to the electrical contact holes 212 of the circuit board 21, and an extension spring strip 2222 extended outwardly from one side thereof and then turned backwardly inwards and terminating in a contact portion 2223 and respectively supported on the stop blocks 224. Further, the power transmission device 23 is mounted at the top side of the circuit board 21 remote from the adapter plate 22 and electrically coupled to the electrical contact holes 212.

When assembling the power adapter, insert the circuit board 21 of the electrical module 2 into the sliding grooves 101 in the accommodation chamber 10 of the adapter body 1 to force the engagement slot 210 of the circuit board 21 into engagement with the positioning partition plate 114 of the positioning structure 11 of the adapter body 1 and to push the adapter plate 22 into the position-limit groove 113, enabling the extension spring strips 2222 of the metal conducting terminals 222 to be received in the receiving chamber 1110 inside the open frame 111 of the positioning structure 11 of the adapter body 1 and the contact portions 2223 of the extension spring strips 2222 to be respectively electrically abutted against the two metal conducting contacts 141 of the electrical plug member 14. Thus, the electrical plug member 14 and the electrical module 2 are electrically connected. After installation of the electrical module 2 in the adapter body 1, the power transmission device 23 is kept facing toward the insertion slot 12 of the adapter body 1. Thereafter, fasten the cover plate 13 to the adapter body 1 to force the retaining lugs 131 and retaining grooves 130 of the cover plate 13 into engagement with to the respective retaining grooves 1020 and retaining lugs 1021 of the adapter body 1 and to abut the at least one abutment plate 132 and the fence 133 against the positioning structure 11 of the adapter body 1 and the power transmission device 23 of the electrical module 2. Thus, the adapter body 1 and the electrical module 2 are assembled together, and the electrical module 2 is firmly positioned in the accommodation chamber 10 of the adapter body 1 against vibration.

Figure 5:
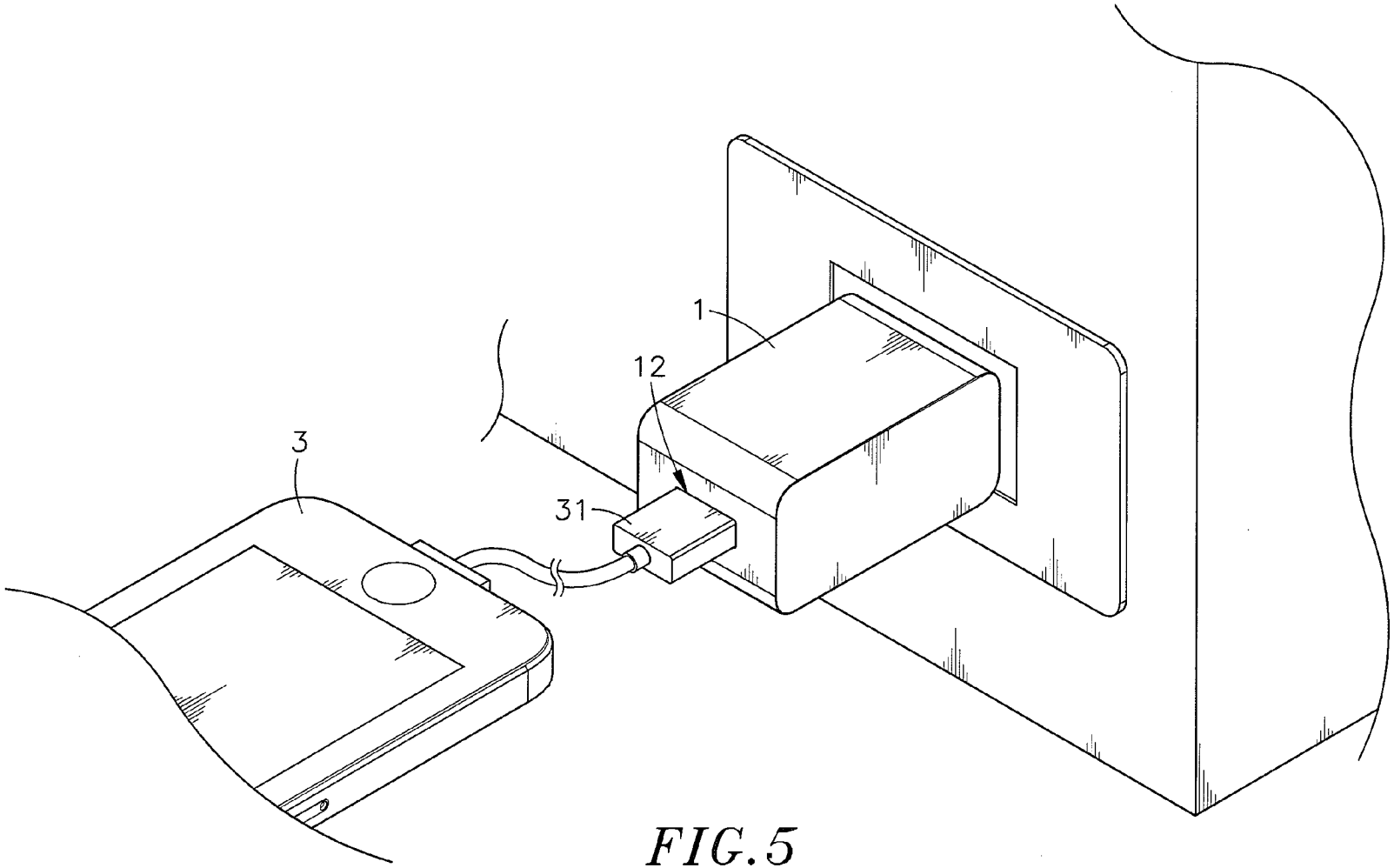
FIG. 5 illustrates an application example of the power adapter in accordance with the present invention.
Figure 6:
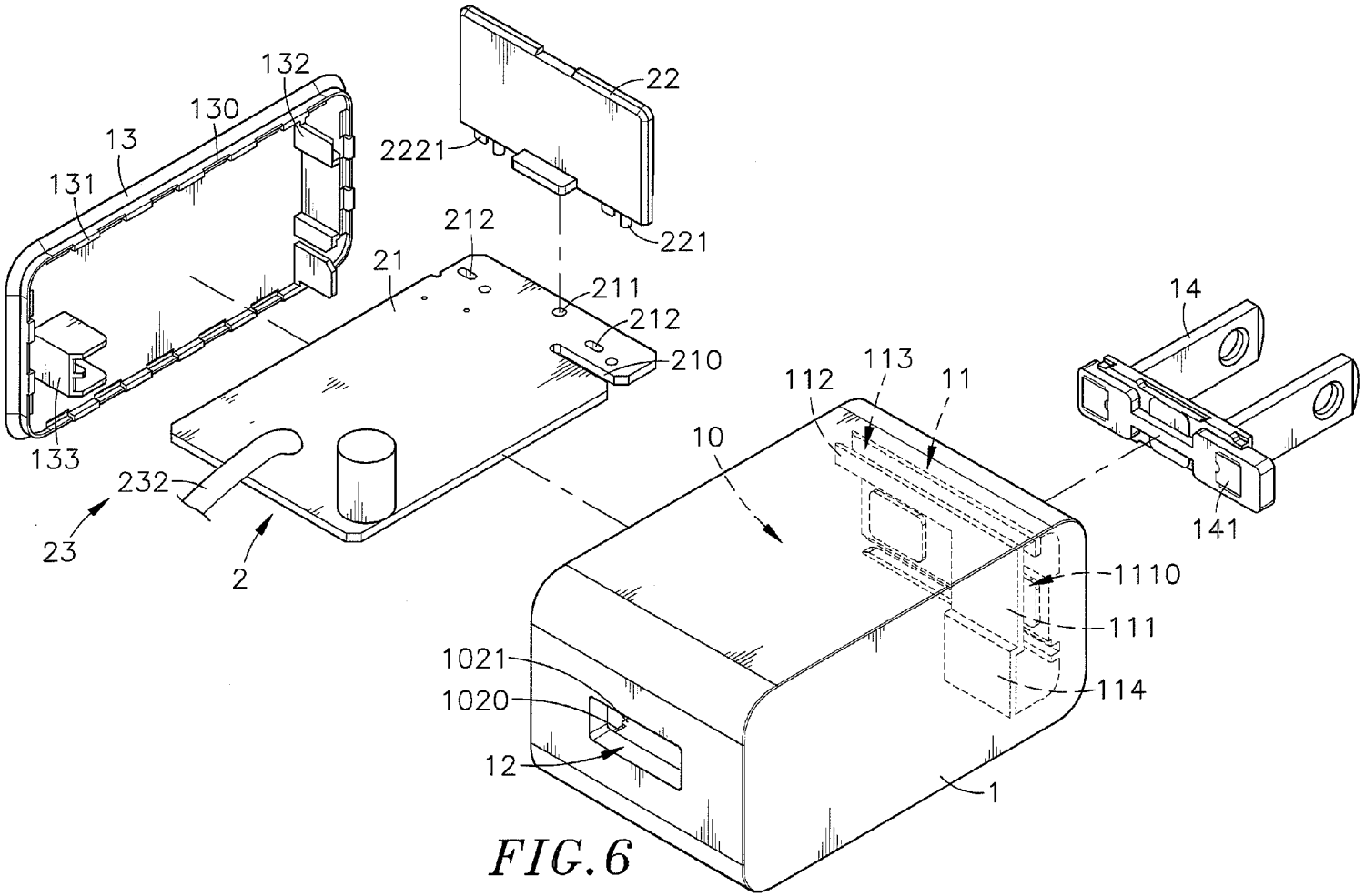
FIG. 6 is an exploded view of an alternate form of the power adapter in accordance with the present invention.
Figure 7:
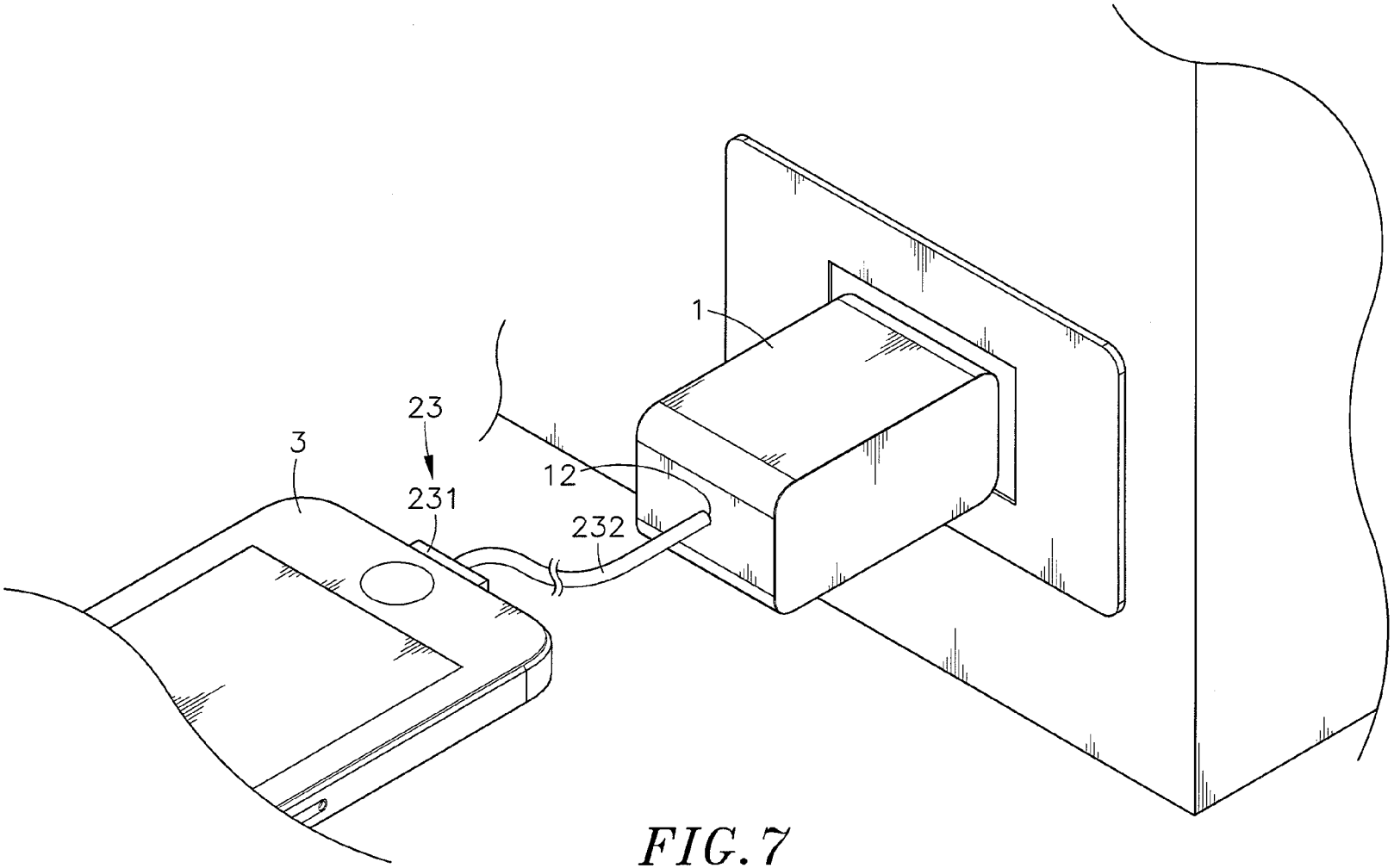
FIG. 7 illustrates an application example of the power adapter shown in FIG. 6.

Referring to FIGS. 5-7 and FIGS. 2 and 3 again, the circuit board 21 of the electrical module 2 has a circuit layout arranged thereon and an AC to DC power converter (not shown) electrically installed in the circuit layout and adapted for converting external AC power supply being obtained from a city power supply outlet through the electrical plug member 14 into DC power supply for output to an external electrically rechargeable mobile electronic device 3 that is connected to the power transmission device 23 of the electrical module 2 through a power cable 31. Further, the power transmission device 23 can be a male or female electrical connector 231, such as male or female USB connector, male or female Micro USB connector, male or female Mini USB connector, etc. for receiving a mating power cable 31 of an external electrically rechargeable mobile electronic device 3. Alternatively, the power transmission device 23 can be a power cable 232 having a male or female electrical connector 231, such as male or female USB connector, male or female Micro USB connector, male or female Mini USB connector, etc. at the distal end thereof electrically connectable to mating female or male electrical connector of an external electrically rechargeable mobile electronic device 3. With the arrangement of the power transmission device 23, the wiring of the circuit board 21 is simplified without extra power lines or signal lines, saving much labor and time and reducing space occupation in the accommodation chamber 10 of the adapter body 1, and thus, the size of the adapter body 1 can be minimized.

Further, as described above, the connection legs 2221 of the metal conducting terminals 222 of the adapter plate 22 are respectively electrically connected to the electrical contact holes 212 of the circuit board 21; the contact portions 2223 of the extension spring strips 2222 of the metal conducting terminals 222 are respectively supported on the stop blocks 224 and positively and electrically abutted against the two metal conducting contacts 141 of the electrical plug member 14. Thus, inputted AC power supply can be positively transmitted through the electrical plug member 14 and the metal conducting terminals 222 of the adapter plate 22 to the circuit board 21 and then converted into DC power supply by the AC to DC power converter of the circuit board 21 for output to an external electrically rechargeable mobile electronic device 3 through the power transmission device 23 of the electrical module 2. The invention uses the adapter plate 22 of the electrical module 2 and the positioning structure 11 of the adapter body 1 to achieves electrical isolation between the electrical plug member 14 and the circuit board 21 without any extra insulation design, facilitating quick installation of the circuit board 21, adapter plate 22 and power transmission device 23 of the electrical module 2 in the accommodation chamber 10 of the adapter body 1 and the receiving chamber 1110 inside the open frame 111.

Further, in actual use of the present invention, insert the electrical plug member 14 (electrical power plug) into a city power supply outlet and connect the power transmission device 23 of the electrical module 2 to an external electrically rechargeable mobile electronic device 3 (such as notebook computer, mobile phone, smart phone, tablet computer, PDA, etc.), enabling city AC power supply to be inputted through the electrical plug member 14 and the metal conducting terminals 222 of the adapter plate 22 into the circuit board 21 and then converted into DC power supply by the AC to DC power converter of the circuit board 21 for output through the power transmission device 23 of the electrical module 2 to charge the external electrically rechargeable mobile electronic device 3.

In conclusion, the invention provides a power adapter, which comprises an adapter body 1 that comprises an accommodation chamber 10, a positioning structure 11 disposed in one end thereof inside the accommodation chamber 10, an insertion slot 12 located in an opposite end thereof and an electrical plug member 14 suspending on the outside remote from the insertion slot 12 for connection to an external power source, and an electrical module 2 that comprises a circuit board 21 mounted in the accommodation chamber 10 for converting inputted AC power supply into DC power supply, an adapter plate 22 fixedly mounted on the circuit board 21 at right angles and inserted into the positioning structure 11 to electrically connect the electrical plug member 14 to the circuit board 21 and a power transmission device 23 electrically connected to the circuit board 21 and facing toward the insertion slot 12 for output of DC power supply to a mating power cable 31 of an external electrically rechargeable mobile electronic device 3.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A power adapter, comprising:

an adapter body comprising an accommodation chamber, a positioning structure disposed in one end thereof inside said accommodation chamber, an insertion slot located in an opposite end thereof in communication between said accommodation chamber and the atmosphere, and an electrical plug member suspending on the outside remote from said insertion slot for connection to an external power source, said electrical plug member comprising two metal conducting contacts suspending inside said positioning structure, wherein said positioning structure comprises an open frame defining therein a receiving chamber for accommodating said adapter plate, a pair of position-limit slats, a position-limit groove defined between said two position-limit slats and a positioning partition plate extended from the open frame and disposed at one lateral side relative to said receiving chamber; and an electrical module comprising a circuit board mounted in said accommodation chamber between said positioning structure and said insertion slot and adapted for converting inputted AC power supply into DC power supply, an adapter plate fixedly mounted on said circuit board and inserted into said positioning structure, two metal conducting terminals fixedly mounted on said adapter plate and respectively kept in contact with said two metal conducting contacts to electrically connect said electrical plug member to said circuit board and a power transmission device electrically connected to said circuit board and facing toward said insertion slot for DC power supply output.

2. The power adapter as claimed in claim 1, wherein said circuit board comprises an engagement slot forced into engagement with said positioning partition plate of said positioning structure of said adapter body.

3. The power adapter as claimed in claim 1, wherein said adapter body further comprises an opening defined in one lateral side thereof in communication with said accommodation chamber, and a cover plate covering said opening, said cover plate comprising at least one abutment plate abutted against said positioning structure.

4. The power adapter as claimed in claim 1, wherein said power transmission device is selected from the group of male and female USB connectors, male and female Micro USB connectors, male and female Mini USB connectors, power cable with an electric plug and power cable with an electric socket.

5. The power adapter as claimed in claim 1, wherein said circuit board comprises a plurality of mounting holes and two electrical contact holes; said adapter plate is fixedly mounted on said circuit board at right angles adapter plate, comprising a plurality of bottom mounting rods respectively press-fitted into said mounting holes of said circuit board; said metal conducting terminals each comprise a connection leg respectively electrically connected to said electrical contact holes of said circuit board.

6. The power adapter as claimed in claim 1, wherein said adapter plate further comprises two pairs of locating rods symmetrically and bilaterally arranged at one side thereof at different elevations, and two stop blocks respectively disposed between the two locating rods of each of said two pairs of locating rods; said metal conducting terminals each comprise a plurality of locating holes respectively fastened to said locating rods and said stop blocks of said adapter plate, and an extension spring strip extended from one side thereof and terminating in a contact portion and respectively supported on said stop blocks.

7. The power adapter as claimed in claim 6, wherein said stop blocks of said adapter plate have a height larger than said locating rods, each said stop block defining a beveled bearing surface for supporting the contact portion of the respective said extension spring strip.

8. The power adapter as claimed in claim 6, wherein each said extension spring strip extended outwardly from one side of the respective said metal conducting terminal and then turned backwardly inwards and terminating in the respective said contact portion and respectively supported on the respective said stop block.

* * * * *